United States Patent [19]

Horn

[11] 4,308,691

[45] Jan. 5, 1982

[54] APPARATUS FOR LOCKING THE LEAF OF A SWING DOOR

[75] Inventor: Manfred Horn, Kaufungen, Fed. Rep. of Germany

[73] Assignee: Firma Gebr. Bode & Co., Kassel, Fed. Rep. of Germany

[21] Appl. No.: 145,000

[22] Filed: Apr. 28, 1980

[30] Foreign Application Priority Data

Jul. 26, 1979 [DE] Fed. Rep. of Germany ..... 2930250

[51] Int. Cl.[3] ..... E05F 7/02

[52] U.S. Cl. ..... 49/255; 49/281; 49/334; 49/394

[58] Field of Search ..... 49/280, 281, 246, 255, 49/256, 333, 334, 335, 336, 394

[56] References Cited

U.S. PATENT DOCUMENTS

| | | | |
|---|---|---|---|
| 3,346,992 | 10/1967 | Lodge | 49/255 |
| 3,820,282 | 6/1974 | Kornylak | 49/255 |
| 3,888,045 | 6/1975 | Piegza | 49/255 |
| 3,902,274 | 9/1975 | Ikio | 49/334 |

FOREIGN PATENT DOCUMENTS

| | | | |
|---|---|---|---|
| 2329263 | 12/1974 | Fed. Rep. of Germany | 49/255 |

*Primary Examiner*—Philip C. Kannan

*Attorney, Agent, or Firm*—Hane, Roberts, Spiecens & Cohen

[57] ABSTRACT

An apparatus for locking a door leaf comprising a turnable shaft secured to the door by an arm to drive the door in opening and closing movements under the action of a piston-drive which produces slight axial movement of the shaft as the door approaches the closed position. A first locking element is fixed to the door frame and a second locking element is fixed to the door, the locking elements having wedge-shaped noses which interengage and lock the locking elements when the door is closed and the shaft is lifted. The locking element on the door frame includes an axial extension overlapping the nose of the locking element on the door to form an abutment to limit the degree of angular closure of the door. The axial extension can carry a friction-reducing insert to facilitate relative movement between the noses when the door is lifted at the end of the closure movement.

6 Claims, 2 Drawing Figures

APPARATUS FOR LOCKING THE LEAF OF A SWING DOOR

FIELD OF THE INVENTION

The invention relates to improvements in locking means for limiting the degree of closure of a door.

PRIOR ART

It is known to produce a swinging movement of a leaf of a swing door by a turnable shaft which is turned by a pusher-piston drive arranged in the axial direction of the turnable shaft and a screw drive arranged in the shaft. It is also known to turn the shaft by means of a motor which is arranged in the axial direction of the turnable shaft which shaft has capability for sliding and turning movement.

When the door leaf has reached its closure position, the drive arrangement has a tendency to lift the door leaf slightly. This lifting movement is used, in known manner, to lock the door.

In a known arrangement for locking the swing door leaf, the locking elements are composed of a pin and a wedge surface, the pin being on the door frame and the wedge surface on the door leaf.

When the door leaf has reached closed position, the movement of the pin along the wedge surface causes a locking of the door leaf in the closed position.

In this construction, relatively high forces act on the pin. In addition, the horizontal closure force of the door leaf must be absorbed by additional supports, for example, abutments, which are arranged at the upper edge of the door frame so that the door seals are not excessively stressed. Furthermore, if the door leaves are slightly bowed, a bending of the leaf may occur, if in the closed position of the door leaf, the closing force is not absorbed at the wedge surface.

SUMMARY OF THE INVENTION

An object of the invention is to provide an arrangement for locking a leaf of a swing door which, on the one hand, avoids the need for additional support means at the door frame and, on the other hand, assures that the closing force of the door leaf does not excessively stress the door seals and the door leaf itself.

According to the invention, this is achieved by a construction in which the locking elements are formed with wedge-shaped noses and the nose provided on the door frame has an extension overlapping the nose on the door leaf to form an abutment for the locking element on the door leaf.

In this manner, it is assured that towards the end of the closure movement, during which the door leaf undergoes a slight lifting movement, not only will the noses move in engagement but, additionally, the nose on the door leaf engages the extension so that a support of the door leaf is achieved in this manner and an overloading of the door seals by the closing force is avoided.

To facilitate the engagement of one nose with the other during the lifting movement, the extension may be provided at the appropriate friction surface with a friction-reducing insert, for example, a plate of synthetic plastic or bronze.

BRIEF DESCRIPTION OF THE FIGURES OF THE DRAWING

An exemplary embodiment is illustrated in the drawing.

DETAILED DESCRIPTION

Figure 1:
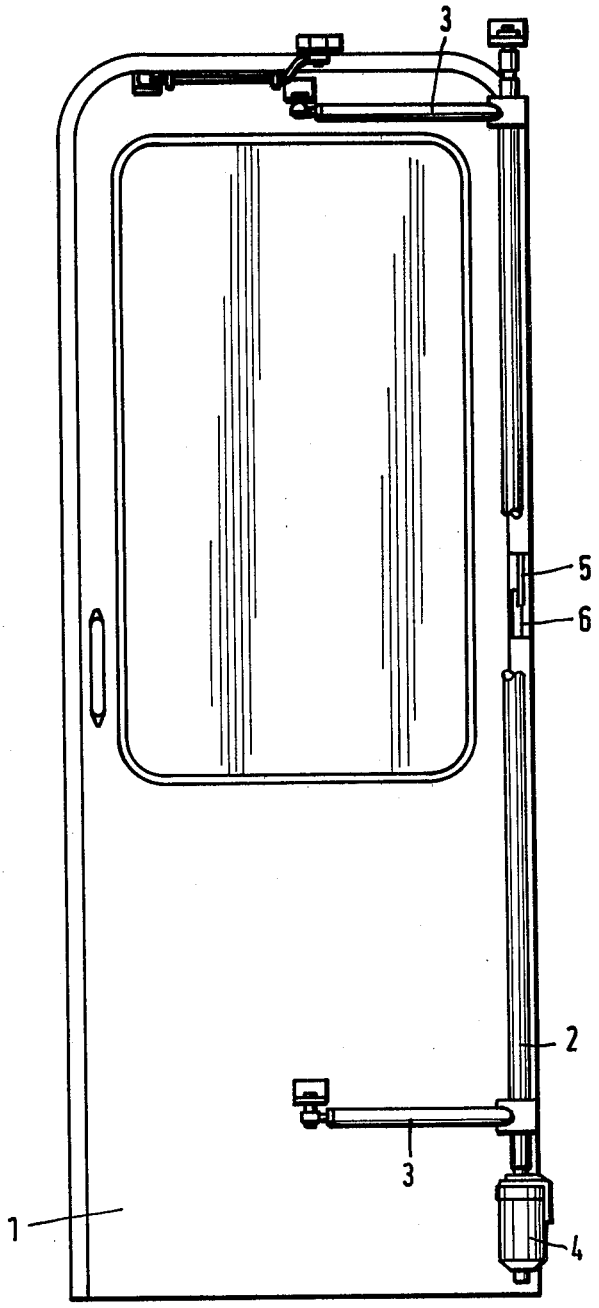
FIG. 1 is an elevational view of a swinging door leaf as viewed from the inside and showing the locking arrangement.

As shown in FIG. 1, a swing door leaf 1 is turnable by swing arms 3 secured on a turnable shaft 2. The drive of the shaft 2 is conventional and is effected by a push-piston drive 4 operatively engaging a screw drive (not shown) accommodated in the turnable shaft.

Towards the end of the closure movement of the door leaf 1, the push-piston drive 4 has the tendency to push in the direction of the shaft axis. This lifting movement is conventionally used for locking purposes.

The present invention is directed to a particular construction of locking means which employs the conventional lifting movement. According to the invention, the door frame and the door leaf are provided with locking members having respective noses 5 and 6 which engage one another near the end of the leaf closure movement and upon the lifting movement of the door leaf 1. The nose 5 of the locking element on the door frame is provided with an axial extension 7 overlapping the nose 6 of the locking element on the door leaf and which constitutes an abutment for the nose 6 and thereby of the locking element whereby the closure of the door leaf is limited by the abutment of the extension 7 with the nose 6. In this manner, the door seals are relieved of stress in the closed position of the door leaf.

The extension 7 is further provided with an insert 8 which is of a friction-reducing material to minimize frictional contact between the extension 7 and nose 6 during the lifting movement when the noses are engaged.

Figure 2:
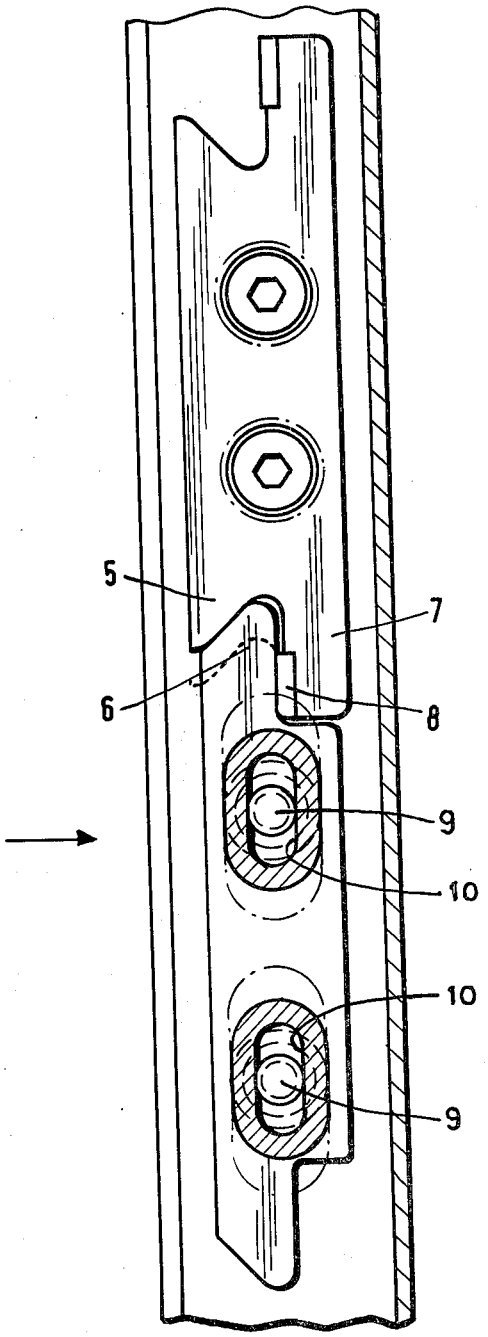
FIG. 2 is a part sectional view of a portion of the locking arrangement on an enlarged scale as seen in side elevation.

The locking element with nose 6 is attached to the door leaf by means of bolts 9 engaged in elongated slots 10 enabling axial adjustment of the point of attachment of the locking element. The extent of the axial adjustment is shown by the chain-dotted outlines in FIG. 2 and will permit a proper engagement of the nose 6 with the nose 5.

When the door leaf is to be opened, the piston drive lowers the door leaf to disengage nose 6 from nose 5 whereafter the shaft 2 is turned to swing the door leaf open.

While the invention has been described in relation to a specific embodiment thereof, it will become apparent to those skilled in the art that numerous modifications and variations can be made within the scope and spirit of the invention as defined in the attached claims.

What is claimed is:

1. In an apparatus for locking a swing door leaf with respect to a door frame comprising a turnable shaft, an arm operatively connecting said shaft with said leaf, and drive means for rotating said shaft to open and close the door leaf, said drive means producing slight axial movement of said shaft as said door leaf appoaches the closed position, the improvement comprising locking apparatus including first and second locking elements respectively on the door frame and door leaf, said locking elements coming into confronting relation when the door leaf approaches the closed position, said locking elements including respective wedge-shaped nose portions which interengage and lock the locking elements when the door leaf is closed and the shaft is axially moved, one of said locking elements including an axial extension overlapping the nose portion of the other locking element to form an abutment for said other locking element to limit the degree of angular closure of the door leaf.

2. The improvement as claimed in claim 1 wherein said one locking element is that locking element on the door frame, and said other locking element is that locking element on the door leaf.

3. The improvement as claimed in claim 2 wherein said abutment has an axial edge facing an axial edge on the other locking element when the locking elements are locked.

4. The improvement as claimed in claim 3 further comprising a friction-reducing insert on one of said axial edges to facilitate interengagement of said edges.

5. The improvement as claimed in claim 4 wherein said insert is on said axial edge of the locking element on the door frame.

6. The improvement as claimed in claim 5 comprising means for axially adjusting the point of attachment of the locking element to the door leaf.

* * * * *